US010706791B2

(12) United States Patent
Yin et al.

(10) Patent No.: US 10,706,791 B2
(45) Date of Patent: Jul. 7, 2020

(54) BACKLIGHT BRIGHTNESS CONTROL METHOD AND DEVICE

(71) Applicant: BOE TECHNOLOGY GROUP CO., LTD., Beijing (CN)

(72) Inventors: Xinshe Yin, Beijing (CN); Masakazu Okamura, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 62 days.

(21) Appl. No.: 16/076,436

(22) PCT Filed: Dec. 20, 2017

(86) PCT No.: PCT/CN2017/117481
§ 371 (c)(1),
(2) Date: Aug. 8, 2018

(87) PCT Pub. No.: WO2018/205629
PCT Pub. Date: Nov. 15, 2018

(65) Prior Publication Data

US 2019/0287466 A1 Sep. 19, 2019

(30) Foreign Application Priority Data

May 12, 2017 (CN) ..... 2017 1 0333211

(51) Int. Cl.
*G09G 3/34* (2006.01)
*G09G 5/10* (2006.01)

(52) U.S. Cl.
CPC ..... *G09G 3/3406* (2013.01); *G09G 3/34* (2013.01); *G09G 5/10* (2013.01); *G09G 2320/0233* (2013.01); *G09G 2320/0626* (2013.01)

(58) Field of Classification Search
CPC ..... G09G 3/3406; G09G 2320/0626
See application file for complete search history.

(56) References Cited

U.S. PATENT DOCUMENTS 6,114,814 A * 9/2000 Shannon ..... H05B 41/2827 315/219
10,288,938 B2 5/2019 Chu et al.
(Continued)

FOREIGN PATENT DOCUMENTS

CN 1390084 A 1/2003
CN 1466408 A 1/2004
(Continued)

OTHER PUBLICATIONS

International Search Report and Written Opinion dated Mar. 19, 2018 from State Intellectual Property Office of the P.R. China.
Chinese Office Action dated Sep. 29, 2019.

*Primary Examiner* — Nitin Patel
*Assistant Examiner* — Robert M Stone
(74) *Attorney, Agent, or Firm* — Dilworth & Barrese, LLP.; Michael J. Musella, Esq.

(57) ABSTRACT

A backlight brightness control method and a backlight brightness control device are provided. The backlight brightness control method includes: acquiring a luminous brightness value of a display panel; determining a relationship between the luminous brightness value and a preset brightness value by a brightness control circuit; transmitting an adjusted current value to a backlight driver module according to the relationship by the brightness control circuit; and generating a current having the adjusted current value by the backlight driver module to drive a backlight module in the display panel to emit light.

6 Claims, 5 Drawing Sheets

(56) References Cited

U.S. PATENT DOCUMENTS

2002/0057238 A1* 5/2002 Nitta ..... G09G 3/342 345/87
2004/0155607 A1* 8/2004 Rust ..... H05B 41/2824 315/291
2005/0190142 A1* 9/2005 Ferguson ..... G09G 3/3406 345/102
2007/0126375 A1* 6/2007 Liu ..... H05B 41/2828 315/307
2007/0152949 A1* 7/2007 Sakai ..... G09G 3/3406 345/102
2007/0153157 A1* 7/2007 Kang ..... G02F 1/1336 349/61
2007/0273613 A1* 11/2007 Mu ..... G09G 3/3406 345/48
2008/0055231 A1* 3/2008 Nose ..... G09G 3/3406 345/102
2012/0050343 A1* 3/2012 Kim ..... G09G 3/3406 345/690
2012/0161646 A1* 6/2012 Wu ..... G09G 3/3413 315/157
2013/0328841 A1* 12/2013 Syed ..... G01J 1/0271 345/207
2014/0055505 A1* 2/2014 Ikeda ..... G09G 3/22 345/690
2014/0098079 A1* 4/2014 Takayanagi ..... G06F 3/1423 345/207
2016/0093254 A1 3/2016 Li et al.
2016/0117970 A1* 4/2016 Matsui ..... G09G 3/3406 345/690
2016/0143103 A1* 5/2016 Kang ..... G09G 3/3426 315/210
2017/0061901 A1* 3/2017 Zhang ..... G09G 3/3426

FOREIGN PATENT DOCUMENTS

CN 1558276 A 12/2004
CN 101290762 A 10/2008
CN 101369405 A 2/2009
CN 101399032 A 4/2009
CN 101604507 A 12/2009
CN 104540295 A 4/2015
CN 105513561 A 4/2016
CN 105788539 A 7/2016
CN 106228935 A 12/2016
CN 106507005 A 3/2017
EP 1077444 A2 2/2001

* cited by examiner

130

BACKLIGHT BRIGHTNESS CONTROL METHOD AND DEVICE

This application claims the benefit of Chinese Patent Application No. 201710333211.0 filed on May 12, 2017, which is hereby entirely incorporated by reference as a part of the present application.

TECHNICAL FIELD

Embodiments of the present disclosure relate to a backlight brightness control method and a backlight brightness control device.

BACKGROUND

With the development of medical display technology, medical imaging diagnosis has been converted from the traditional hard reading films such as films to soft reading films such as medical displays. Medical displays are adopted to display DR, CR, CT and 3D images, and then diagnosis is performed.

In addition to the requirements such as high brightness, high contrast, high resolution, large size and high grayscale, medical displays needs to meet the requirements of consistency and integrity of the display quality. Consistency means that when the medical display is used for different time periods, the display quality (brightness, grayscale, contrast, etc.) of the medical display needs to be consistent for the same image. In addition, integrity means that the display qualities (brightness, grayscale, contrast, etc.) of the same image displayed by the medical display at workstations in different places are exactly the same, so as to ensure that the images seen by doctors in the different places are the same.

SUMMARY

Embodiments of the present disclosure provide a backlight brightness control method and a backlight brightness control device. The backlight brightness control method includes: acquiring a luminous brightness value of a display panel; determining a relationship between the luminous brightness value and a preset brightness value by a brightness control circuit to; calculating a current value to be adjusted according to the relationship by the brightness control circuit and transmitting an adjusted current value to a backlight driver module by the brightness control circuit; and generating a current having the adjusted current value by the backlight driver module to drive a backlight module in the display panel to emit light. Therefore, the backlight brightness control method realizes the stable control of the backlight brightness by determining the relationship between the luminous brightness value of the display panel and the preset brightness value at first and then adjusting the luminous brightness of the backlight module by adjusting the value of the current.

At least one embodiment of the present disclosure provides a backlight brightness control method including: acquiring a luminous brightness value of a display panel; determining a relationship between the luminous brightness value and a preset brightness value by a brightness control circuit to; calculating a current value to be adjusted according to the relationship by the brightness control circuit and transmitting an adjusted current value to a backlight driver module by the brightness control circuit; and generating a current having the adjusted current value by the backlight driver module to drive a backlight module in the display panel to emit light.

For example, the backlight brightness control method provided by an embodiment of the present disclosure further includes: transmitting a duty cycle value to the backlight driver module by the brightness control circuit; and controlling a duty cycle of the current having the adjusted current value according to the duty cycle value by the backlight driver module.

For example, in the backlight brightness control method provided by an embodiment of the present disclosure, the duty cycle value is 100%.

For example, the backlight brightness control method provided by an embodiment of the present disclosure further includes: transmitting an initial current value to the backlight driver module by the brightness control circuit before acquiring the luminous brightness value of the display panel.

For example, in the backlight brightness control method provided in an embodiment of the present disclosure, transmitting of the adjusted current value to the backlight driver module according to the relationship by the brightness control circuit includes: in a case where the luminous brightness value is greater than the preset brightness value, acquiring the adjusted current value by subtracting a current change value from the initial current value by the brightness control circuit and transmitting the adjusted current value to the backlight driver module by the brightness control circuit; and in a case where the luminous brightness value is less than the preset brightness value, acquiring the adjusted current value by adding a current change value to the initial current value by the brightness control circuit and transmitting the adjusted current value to the backlight driver module by the brightness control circuit. The adjusted current value is adjusted according to the relationship between the luminous brightness value and the preset brightness value, so that a luminous brightness of the display panel reaches the preset brightness value.

For example, in the backlight brightness control method provided in an embodiment of the present disclosure, acquiring of the luminous brightness value of the display panel includes: arranging a brightness sensor on a light-emitting side of the backlight module or a light-emitting side of a display module in the display panel, and outputting a brightness sensing signal; and acquiring the luminous brightness value of the display panel according to the brightness sensing signal.

For example, in the backlight brightness control method provided in an embodiment of the present disclosure, acquiring of the luminous brightness value of the display module further includes: arranging a standard brightness tester on a light-emitting side of the display panel, and measuring the luminous brightness value of the display panel; adjusting the display panel to change a luminous brightness; acquiring a plurality of luminous brightness values under different luminous brightness measured by the standard brightness tester; acquiring a plurality of brightness sensing signals under different luminous brightness sensed by the brightness sensor; establishing a corresponding relationship between the plurality of luminous brightness values and the plurality of brightness sensing signals; and determining the luminous brightness value of the display panel according to the brightness sensing signal outputted by the brightness sensor and the corresponding relationship.

For example, in the backlight brightness control method provided by an embodiment of the present disclosure, the plurality of luminous brightness values comprise the preset brightness value; and determining of the relationship between the luminous brightness value and the preset brightness value by the brightness control circuit includes: determining a brightness sensing signal corresponding to the preset brightness value according to the preset brightness value and the corresponding relationship; and comparing a value of the brightness sensing signal outputted by the brightness sensor with a value of the brightness sensing signal corresponding to the preset brightness value.

For example, in the backlight brightness control method provided by an embodiment of the present disclosure, the preset brightness value is less than a maximum brightness value of the display panel.

At least one embodiment of the present disclosure provides a backlight brightness control device including: a brightness sensor configured to acquire a brightness sensing signal of a display panel; a brightness control circuit communicated with the brightness sensor; and a backlight driver module communicated with the brightness control circuit and electrically connected with a backlight module of the display panel. The brightness control circuit is configured to acquire a luminous brightness value of the display panel according to the brightness sensing signal, determine a relationship between the luminous brightness value and a preset brightness value, and transmit an adjusted current value to the backlight driver module according to the relationship; and the backlight driver module generates a current having the adjusted current value to drive the backlight module in the display panel to emit light.

For example, in the backlight brightness control device provided by an embodiment of the present disclosure, the brightness sensor is on a light-emitting side of the backlight module in the display panel or a light-emitting side of a display module in the display panel.

For example, in the backlight brightness control device provided by an embodiment of the present disclosure, the brightness control circuit is also configured to transmit a duty cycle value to the backlight driver module; and the backlight driver module is configured to control a duty cycle of the current having the adjusted current value according to the duty cycle value.

For example, in the backlight brightness control device provided by an embodiment of the present disclosure, the duty cycle value is 100%.

For example, in the backlight brightness control device provided by an embodiment of the present disclosure, the backlight driver module includes: a driving power supply configured to generate a driving voltage and adjust a current for driving the backlight module to emit light by adjusting the driving voltage; and a current feedback circuit comprising a feedback resistor connected in series with the backlight module. The current feedback circuit is configured to feed back the current for driving the backlight module to emit light according to a feedback voltage on the feedback resistor.

For example, in the backlight brightness control device provided by an embodiment of the present disclosure, the backlight driver module further includes a current-limiting resistor, and a digital potentiometer communicated and connected with the brightness control circuit and configured to convert the adjusted current value into resistance, an end of the current-limiting resistor is connected with a standard reference voltage, and another end of the current-limiting resistor is connected to the digital potentiometer, so as to generate an adjustment voltage at an end, connected with the current-limiting resistor, of the digital potentiometer, in a case where the adjusted current value is inputted into the digital potentiometer; and the driving power supply is configured to compare the feedback voltage with the adjustment voltage and adjust the driving voltage according to a comparison result.

For example, in the backlight brightness control device provided by an embodiment of the present disclosure, the backlight driver module further includes a power interface configured to be connected with an input power supply and a pulse-width modulation (PWM) interface configured to be connected with a PWM bus, the input power supply is configured to supply power for the backlight driver module, and the PWM bus is configured to transmit a duty cycle value transmitted by the brightness control circuit to the backlight driver module. At least one embodiment of the present disclosure provides a display device which includes a display panel including a display module and a backlight module, and a backlight brightness control device which includes the backlight brightness control device according to any one of the above embodiments.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," and so on, which are used in the description and the claims of the present application for disclosure, are not intended to indicate any sequence, amount or importance, but distinguish various components. The terms "comprise," "comprising," "include," "including," and so on, are intended to specify that the elements or the objects stated before these terms encompass the elements or the objects and equivalents thereof listed after these terms, but do not preclude the other elements or objects. The phrases "connect", "connected", and so on, are not intended to define a physical connection or mechanical connection, but may include an electrical connection, directly or indirectly.

Figure 1:
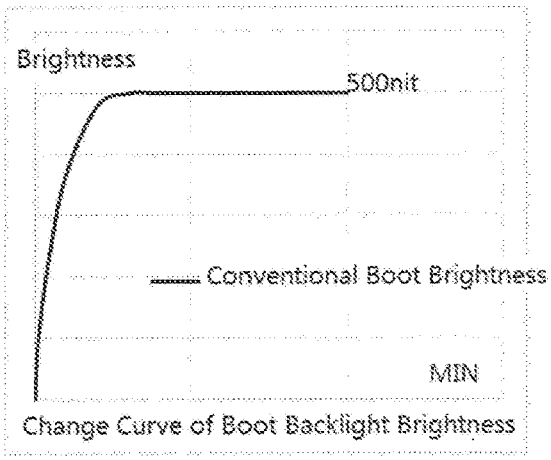
FIG. 1 is a curve diagram illustrating the change of the brightness of a display device along with the boot time.
Figure 2:
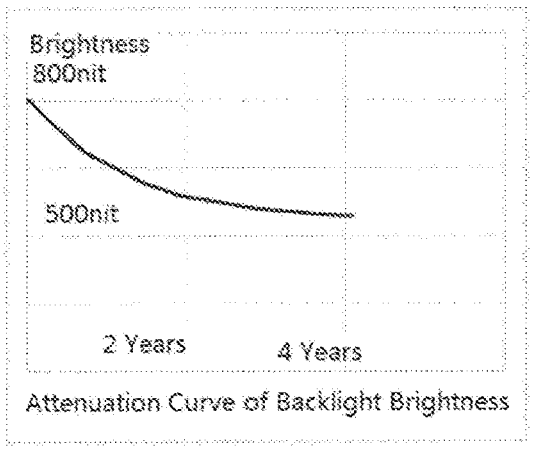
FIG. 2 is a curve diagram illustrating the change of the brightness of the display device along with the use time.
Figure 3:
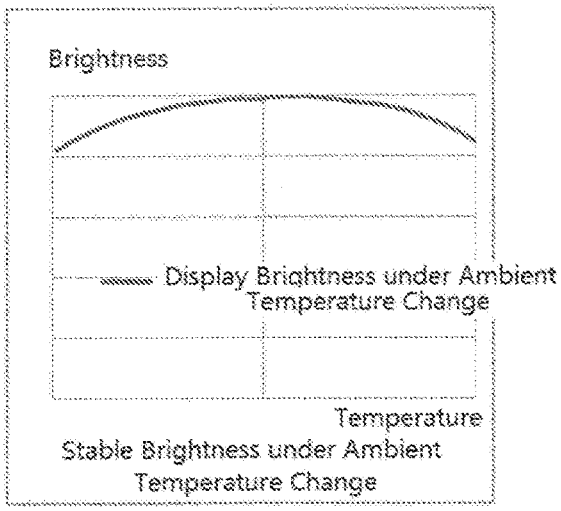
FIG. 3 is a curve diagram illustrating the change of the brightness of the display device along with the ambient temperature.

The inventors of the application have noted that: FIG. 1 is a curve diagram illustrating the change of the brightness of a display device along with the boot time; and as shown in FIG. 1, in the process of cold boot of a backlight module in a conventional display device, the working temperature of drive elements and luminous elements (e.g., light-emitting diodes (LEDs)) in the backlight module is relatively low, so the brightness of the backlight generated by the backlight module cannot reach stable brightness at one time, and usually takes half an hour to an hour to reach the stable brightness. Thus, the conventional display device has low brightness within half an hour to one hour after boot. FIG. 2 is a curve diagram illustrating the change of the brightness of the display device along with the use time. As shown in FIG. 2, when the display device is used for a long time, e.g., several years, the luminous efficiency of the luminous elements (e.g., LEDs) in the backlight module are reduced, so the brightness of the backlight generated by the backlight module is reduced. Thus, the brightness of the conventional display device is reduced after long-term use. FIG. 3 is a curve diagram illustrating the change of the brightness of the display device along with the ambient temperature. As shown in FIG. 3, when the ambient temperature changes, the brightness of the backlight generated by the backlight module also changes. Therefore, in order to meet the requirements of consistency and integrity of the display quality, the stable control of the brightness of the medical display needs to be realized.

Figure 4:
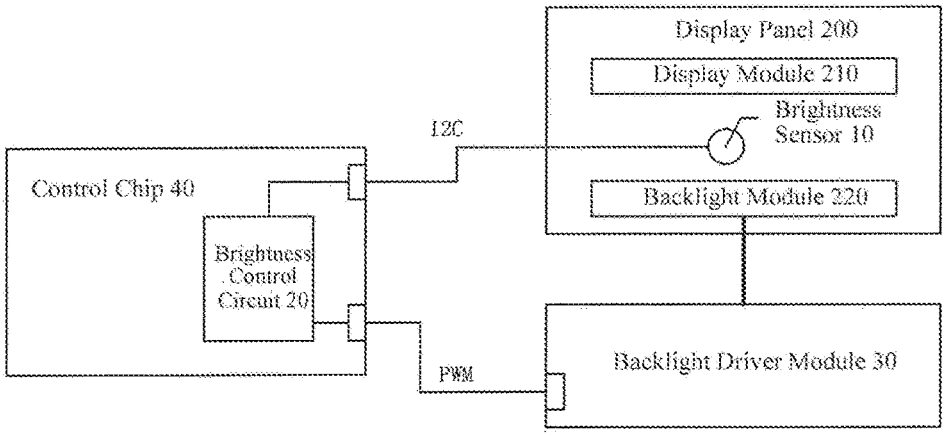
FIG. 4 is a schematic diagram of a backlight brightness control device.

FIG. 4 is a schematic diagram of a backlight brightness control device. As shown in FIG. 4, the backlight brightness control device includes: a brightness sensor 10, a brightness control circuit 20 and a backlight driver module 30. The brightness sensor 10 is configured to acquire a brightness sensing signal of a display panel 200. The brightness control circuit 20 is configured to acquire the luminous brightness value of the display panel 200 according to the brightness sensing signal, determine the relationship between the luminous brightness value and a preset brightness value, adjust the duty cycle of the current of the backlight driver module 30 and for driving a backlight module 220 of the display panel 200 by pulse-width modulation (PWM), and then achieve the control of a backlight brightness. However, in the backlight brightness control device, the backlight driver module needs to set the current for driving the backlight module in the display panel to be the maximum, so the backlight module is always driven by the maximum current, and hence the reliability and the service life of the backlight module is reduced.

Embodiments of the present disclosure provide a backlight brightness control method and a backlight brightness control device. The backlight brightness control method includes: acquiring a luminous brightness value of a display panel; determining a relationship between the luminous brightness value and a preset brightness value by a brightness control circuit to; calculating a current value to be adjusted according to the relationship by the brightness control circuit and transmitting an adjusted current value to a backlight driver module by the brightness control circuit; and generating a current having the adjusted current value by the backlight driver module to drive a backlight module in the display panel to emit light. Therefore, the backlight brightness control method realizes the stable control of the backlight brightness by determining the relationship between the luminous brightness value of the display panel and the preset brightness value at first and then adjusting the luminous brightness of the backlight module by adjusting the value of the current.

Description will be given below to the backlight brightness control method and the backlight brightness control device, provided by the embodiments of the present disclosure, with reference to the accompanying drawings.

Figure 5:
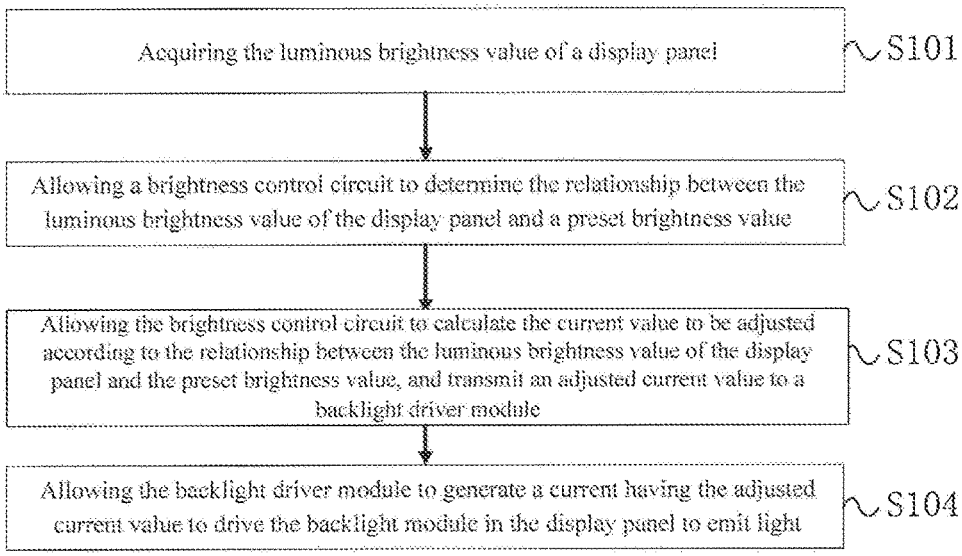
FIG. 5 is a flowchart of a backlight brightness control method provided by one embodiment of the present disclosure.

One embodiment of the present disclosure provides a backlight brightness control method. FIG. 5 is a flowchart of the backlight brightness control method provided by the embodiment of the present disclosure. As shown in FIG. 5, the backlight brightness control method includes the following steps S101-S104.

Step S101: acquiring the luminous brightness value of a display panel.

For instance, the luminous brightness value of the display panel is acquired by a brightness sensor.

Step S102: allowing a brightness control circuit to determine the relationship between the luminous brightness value of the display panel and a preset brightness value.

Step S103: allowing the brightness control circuit to calculate a current value to be adjusted according to the relationship between the luminous brightness value of the display panel and the preset brightness value, and transmit an adjusted current value to a backlight driver module.

For instance, in a case where the luminous brightness value is greater than the preset brightness value, the adjusted current value is obtained by subtracting a change value from the present current value of a backlight module; and in a case where the luminous brightness value is less than the preset brightness value, the adjusted current value is obtained by adding a change value to the present current value of the backlight module.

Step S104: allowing the backlight driver module to generate a current having the adjusted current value to drive the backlight module in the display panel to emit light.

It should be noted that the preset brightness value is a value set according to actual needs, and is also a target brightness value to be achieved by the backlight brightness control method provided by this embodiment.

For instance, the brightness control circuit includes a processor and a memory. The memory stores programs for implementing the above steps. The processor is configured to execute the programs stored in the memory. It should be noted that the embodiments of the present disclosure include but not limited thereto. The brightness control circuit may also be a circuit capable of realizing the above determining function.

Figure 6:
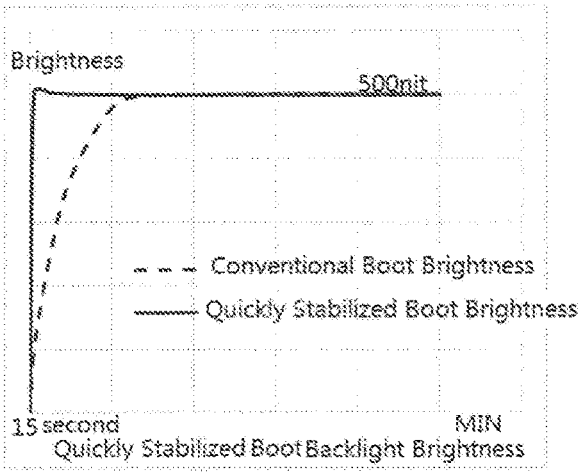
FIG. 6 is a curve diagram illustrating the change of the brightness of a display device, in the backlight brightness control method provided by one embodiment of the present disclosure, along with the boot time.
Figure 7:
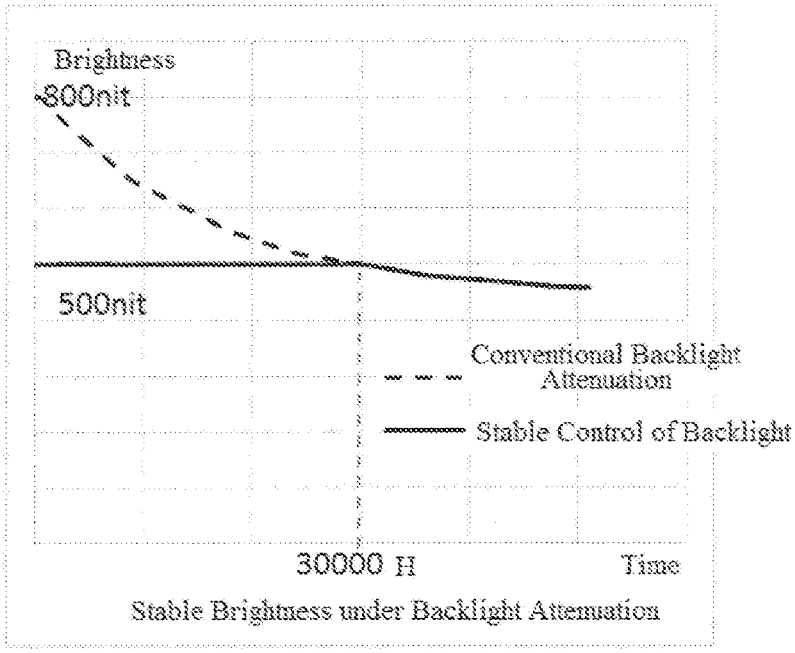
FIG. 7 is a curve diagram illustrating the change of the brightness of the display device, in the backlight brightness control method provided by one embodiment of the present disclosure, along with the use time.
Figure 8:
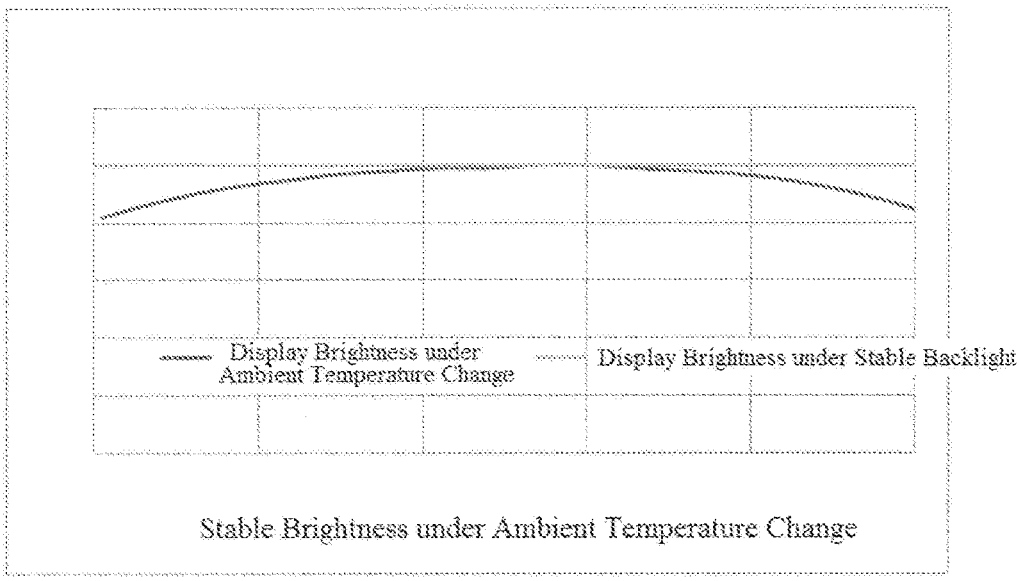
FIG. 8 is a curve diagram illustrating the change of the brightness of the display device, in the backlight brightness control method provided by one embodiment of the present disclosure, along with the ambient temperature.

In the backlight brightness control method provided by the embodiment, the stable control of the backlight brightness is realized by determining the relationship between the luminous brightness value of the display panel and the preset brightness value at first and then adjusting the luminous brightness of the backlight module by adjusting the value of current. In the process of cold boot of a display device employing the backlight brightness control method provided by the embodiment of the present disclosure, as shown in FIG. 6 which is a curve diagram illustrating the change of the brightness of the display device, employing the backlight brightness control method provided by the embodiment of the present disclosure, along with the boot time, within half an hour to an hour after boot, the current for driving the backlight module may be increased by the above method, so that the brightness of the backlight generated by the backlight module can be increased to reach the preset brightness value; and after the luminous efficiency of the backlight module is stabilized, the current for driving the backlight module may be reduced by the above method, so that the backlight module cannot generate high brightness to maintain the preset brightness value, and hence the stable control of the backlight brightness can be realized. FIG. 7 is a curve diagram illustrating the change of the brightness of the display device, employing the backlight brightness control method provided by the embodiment, along with the use time. As shown in FIG. 7, the preset brightness value may be set to be less than the maximum brightness value of the display device when the display device is just getting started; and after the display device employing the backlight brightness control method provided by the embodiment is used for a long time, e.g., several years, the current for driving the backlight module may be reduced by the above method, so that the backlight module cannot generate high brightness to maintain the preset brightness value. FIG. 8 is a curve diagram illustrating the change of the display device, employing the backlight brightness control method provided by the embodiment, along with the ambient temperature. As shown in FIG. 8, the current for driving the backlight module may be increased or reduced by the above method, so that the backlight brightness generated by the backlight module can remain stable, and hence the stable control of the backlight brightness can be realized.

For instance, in the backlight brightness control method provided by one example of the embodiment, the preset brightness value is less than the maximum brightness value of the display panel. Thus, a redundancy can be ensured when the display device has a short service life, thereby ensuring that the display device maintains stable brightness throughout the life cycle. In addition, in the process of controlling the backlight brightness by adjusting the duty cycle of the current for driving the backlight module, the maximum current is adopted to drive luminous elements (e.g., LEDs) in the backlight module of the display panel. However, in the process of controlling the backlight brightness by the backlight brightness control method provided by the embodiment, the current of the luminous elements (e.g., LEDs) in the backlight module of the display panel is small, so long-term high current drive can be avoided, and hence the reliability and the stability of the luminous elements (e.g., LEDs) can be improved.

For instance, the preset brightness value may be set to be 50%-75% of the maximum brightness value of the display panel, so sufficient brightness can be guaranteed on one hand and stable brightness of the display device can be maintained throughout the life cycle of the display device on the other hand. It should be noted that: when the preset brightness value is set to be low, the current value required by the display panel to reach the preset brightness value may be a low current value, so the current for driving the backlight module is gradually increased when the luminous efficiency is reduced and the brightness is reduced along with the aging of components such as the luminous elements in the backlight module. Therefore, the components such as the luminous elements (e.g., LEDs) in the backlight module do not need to operate at the maximum current for a long time, thereby ensuring the reliability of the components such as the luminous elements (e.g., LEDs) in the backlight module.

For instance, the backlight brightness control method provided by one example of the embodiment may further include: allowing the brightness control circuit to transmit a duty cycle value to the backlight driver module; and allowing the backlight driver module to control a duty cycle of the current having the adjusted current value according to the duty cycle value. Thus, in addition to the stable control of the backlight brightness, the backlight brightness control method provided by the embodiment also provides a way of adjusting the backlight brightness by adjusting the duty cycle of the current having the adjusted current value. That is to say, the backlight brightness control method provided by the embodiment not only can achieve the stable control of the backlight brightness but also can adjust the backlight brightness. For instance, when the display device employing the backlight brightness control method provided by the embodiment is used for diagnostic treatment, the backlight brightness control method provided by the embodiment can achieve the stable control of the backlight brightness to ensure the consistency and the integrity of medical images (e.g., DR, CR, CT and 3D images) displayed by the display device; and when the display device employing the backlight brightness control method provided by the embodiment is used for other general purposes, the user may adjust the brightness according to own preferences by the backlight brightness control method provided by the embodiment.

For instance, in the backlight brightness control method provided by one example of the embodiment, when the display panel is used for medical diagnosis, the above duty cycle is 100%, so as to ensure the consistency and the integrity of the medical images (e.g., DR, CR, CT and 3D images) displayed by the display panel. It should be noted that when the display panel is used for medical diagnosis, gamma curves of the images displayed by the display panel apply the DICOM standard; in this case, the required duty cycle is 100%, and the required contrast is also 100%; and it is ensured that a medical display displays the maximum brightness at 255 grayscale by the backlight brightness control method provided by the embodiment, and other grayscales meet the DICOM standard. It should be noted that: when the display panel is used for medical diagnosis, the user cannot adjust the brightness, the contrast and the duty cycle, so as to ensure the consistency and the integrity of the medical images (e.g., DR, CR, CT and 3D images).

For instance, the backlight brightness control method provided by one example of the embodiment further includes: allowing the brightness control circuit to transmit an initial current value to the backlight driver module before the step of acquiring the luminous brightness value of the display panel. It should be noted that the initial current value may be set according to actual situations. For instance, the initial current value may be determined according to the technological parameters of the luminous elements in the backlight module, or the initial current value is set to be the current value determined by a test to reach the preset brightness value (the current value reaching the preset brightness value will be changed along with the use and the aging of the display panel).

For instance, in the backlight brightness control method provided by one example of the embodiment, the step of allowing the brightness control circuit to transmit the adjusted current value to the backlight driver module according to the relationship between the luminous brightness value of the display panel and the preset brightness value includes: allowing the brightness control circuit to acquire the adjusted current value by subtracting a current change value from the initial current value, and transmit the adjusted current value to the backlight driver module, in a case where the luminous brightness value is greater than the preset brightness value; and allowing the brightness control circuit to acquire the adjusted current value by adding a current change value to the initial current value, and transmit the adjusted current value to the backlight driver module, in a case where the luminous brightness value is less than the preset brightness value. The adjusted current value is adjusted (e.g., adjusted for a plurality of times) according to the relationship between the luminous brightness value and the preset brightness value, so that the luminous brightness value of the display panel can reach the preset brightness value.

For instance, in the backlight brightness control method provided by one example of the embodiment, the step of acquiring the luminous brightness value of the display panel includes: arranging a brightness sensor on a light-emitting side of the backlight module in the display panel or a light-emitting side of the display module in the display panel, and outputting a brightness sensing signal; and acquiring the luminous brightness value of the display panel according to the brightness sensing signal. Thus, the luminous brightness value of the display panel is acquired by the brightness sensor arranged on the light-emitting side of the backlight module or the light-emitting side of the display module. It should be noted that: in a case where the brightness sensor is arranged on the light-emitting side of the display panel, at this point, the luminous brightness of the display panel is equal to the brightness of the light-emitting side of the display module; and in a case where the brightness sensor is arranged on the light-emitting side of the backlight module, at this point, the brightness of the light-emitting side of the backlight module is several times to several ten times of the luminous brightness of the display panel.

Figure 9:
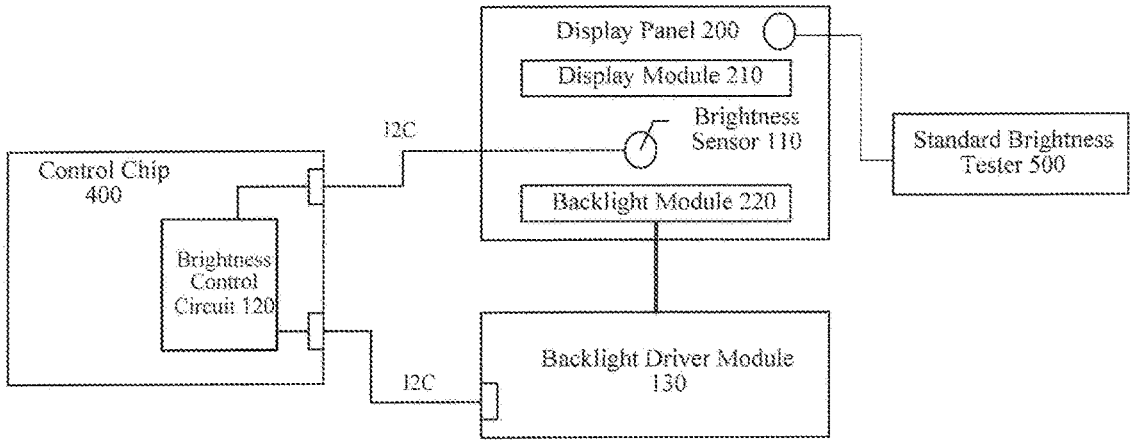
FIG. 9 is a schematic diagram illustrating the process of acquiring the luminous brightness value of a display panel in one embodiment of the present disclosure.

For instance, in the backlight brightness control method provided by one example of the embodiment, the step of acquiring the luminous brightness value of the display module includes: as shown in FIG. 9, arranging a standard brightness tester 500 on a light-emitting side of a display module 210, and measuring the luminous brightness value of a display panel 200; adjusting the display panel to change the luminous brightness; acquiring a plurality of luminous brightness values under different luminous brightness measured by the standard brightness tester 500; acquiring a plurality of brightness sensing signals under different luminous brightness sensed by a brightness sensor 110; establishing corresponding relationship between the plurality of luminous brightness values and the plurality of brightness sensing signals; and determining the luminous brightness value of the display panel according to the brightness sensing signal outputted by the brightness sensor 110 and the corresponding relationship. Therefore, on one hand, the corresponding relationship may be established according to the luminous brightness values of the display panel measured by the standard brightness tester under different luminous brightness and the brightness sensing signals outputted by the brightness sensor; and on the other hand, the brightness sensor may be corrected through the standard brightness tester.

For instance, Table 1 is a table illustrating the corresponding relationship between the plurality of luminous brightness values and the plurality of brightness sensing signals. As shown in Table 1, the plurality of brightness sensing signals may be hexadecimal digital signals, e.g., A5, AA and AE. According to the corresponding relationship between the plurality of luminous brightness values and the plurality of brightness sensing signals in Table 1, when the brightness sensing signal sensed by the brightness sensor is A5, at this point, the luminous brightness value of the display panel is 490 nit; when the brightness sensing signal sensed by the brightness sensor is AA, at this point, the luminous brightness value of the display panel is 500 nit; and when the brightness sensing signal sensed by the brightness sensor is AE, at this point, the luminous brightness value of the display panel is 510 nit. Of course, the corresponding relationship table between the plurality of luminous brightness values and the plurality of brightness sensing signals as shown in Table 1 is only for the purpose of illustrating the corresponding relationship between the plurality of luminous brightness values and the plurality of brightness sensing signals. The embodiment of the present disclosure includes but not limited thereto.

TABLE 1

Corresponding Relationship Table between the Plurality of Luminous Brightness Values and the Plurality of Brightness Sensing Signals

| Serial Number | Brightness Sensing Signal | Luminous Brightness Value of Display Panel | Remarks |
|---|---|---|---|
| 1 | A5 | 490 nit | |
| 2 | AA | 500 nit | |
| 3 | AE | 510 nit | |

For instance, in the backlight brightness control method provided by one example of the embodiment, the plurality of luminous brightness values include the preset brightness value. The step of allowing the brightness control circuit to determine the relationship between the luminous brightness value and the preset brightness value includes: determining a brightness sensing signal corresponding to the preset brightness value according to the preset brightness value and the corresponding relationship, in which for instance, when the preset brightness value is 500 nit, the brightness sensing signal (hexadecimal) corresponding to the preset brightness value may be determined to be AA according to the corresponding relationship table between the plurality of luminous brightness values and the plurality of brightness sensing signals as shown in Table 1; comparing the brightness sensing signal outputted by the brightness sensor with the brightness sensing signal corresponding to the preset brightness value, in which for instance, when the brightness sensing signal outputted by the brightness sensor is A5, A5 is less than AA, namely the luminous brightness value is less than the preset brightness value; when the brightness sensing signal outputted by the brightness sensor is AA, AA is equal to AA, namely the luminous brightness value is equal to the preset brightness value; and when the brightness sensing signal outputted by the brightness sensor is AE, AE is greater than AA, namely the luminous brightness value is greater than the preset brightness value.

Figure 10:
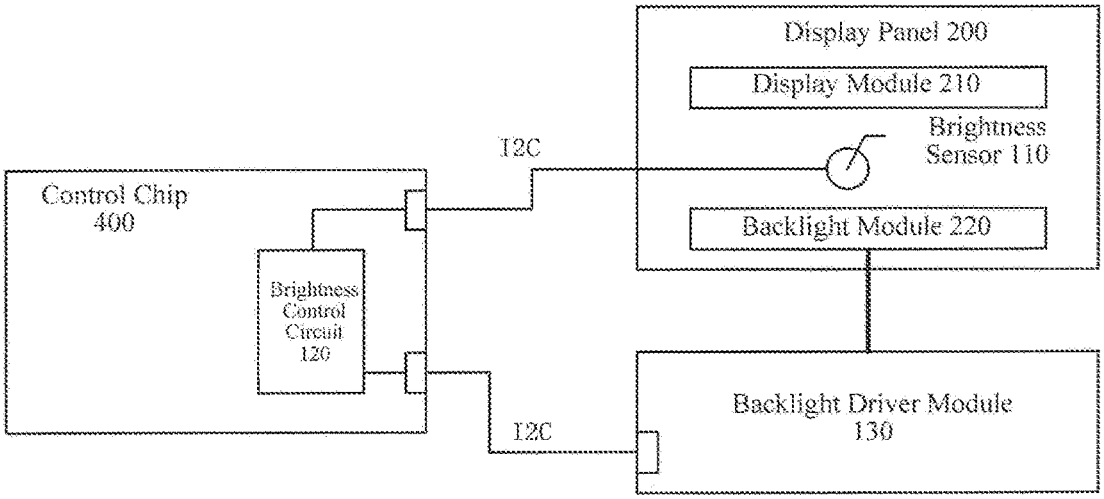
FIG. 10 is another schematic diagram of the backlight brightness control device provided by one embodiment of the present disclosure.

One embodiment of the present disclosure provides a backlight brightness control device. FIG. 10 illustrates the backlight brightness control device provided by the embodiment. As shown in FIG. 10, the backlight brightness control device includes: a brightness sensor 110, a brightness control circuit 120 and a backlight driver module 130. The brightness sensor 110 is configured to acquire a brightness sensing signal of a display panel 200; the brightness control circuit 120 is communicated and connected with the brightness sensor 110; and the backlight driver module 130 is communicated and connected with the brightness control circuit 120 and electrically connected with a backlight module 220 of the display panel 200. The brightness control circuit 120 is configured to acquire the luminous brightness value of the display panel 200 according to the brightness sensing signal, determine the relationship between the luminous brightness value and the preset brightness value, and transmit an adjusted current value to the backlight driver module according to the relationship between the luminous brightness value and the preset brightness value; and the backlight driver module generates a current having the adjusted current value to drive the backlight module 220 in the display panel 200 to emit light.

In the backlight brightness control device provided by the embodiment, the backlight control module realizes the stable control of the backlight brightness by determining the relationship between the luminous brightness value of the display panel and the preset brightness value at first and then adjusting the luminous brightness of the backlight module by adjusting a value of the current.

For instance, in the backlight brightness control device provided by one example of the embodiment, the preset brightness value is less than the maximum brightness value of the display panel. Thus, a redundancy can be ensured when the display device has a short service life, thereby ensuring that the display device maintains stable brightness throughout the life cycle. In addition, in the process of controlling the backlight brightness by adjusting the duty cycle of the current for driving the backlight module, the maximum current is adopted to drive luminous elements (e.g., LEDs) in the backlight module of the display panel. However, in the process of controlling the backlight brightness by the backlight brightness control device provided by the embodiment, the current of the luminous elements (e.g., LEDs) in the backlight module of the display panel is small, so long-term high current drive can be avoided, and hence the reliability and the stability of the luminous elements (e.g., LEDs) can be improved.

For instance, as shown in FIG. 10, the brightness control circuit 120 is communicated and connected with the brightness sensor 110 through an I2C bus. It should be noted that I2C refers to an inter-integrated circuit, and is a data exchange serial data interface line between two chips, so that a small amount of digital data signals can be transmitted between the two chips in two directions. For instance, as shown in FIG. 10, the backlight driver module 130 is communicated and connected with the brightness control circuit 120 through the I2C bus.

For instance, the brightness sensor is arranged on a light-emitting side of the backlight module in the display panel or a light-emitting side of the display module in the display panel. No limitation will be given here in the embodiment of the present disclosure.

Figure 11:
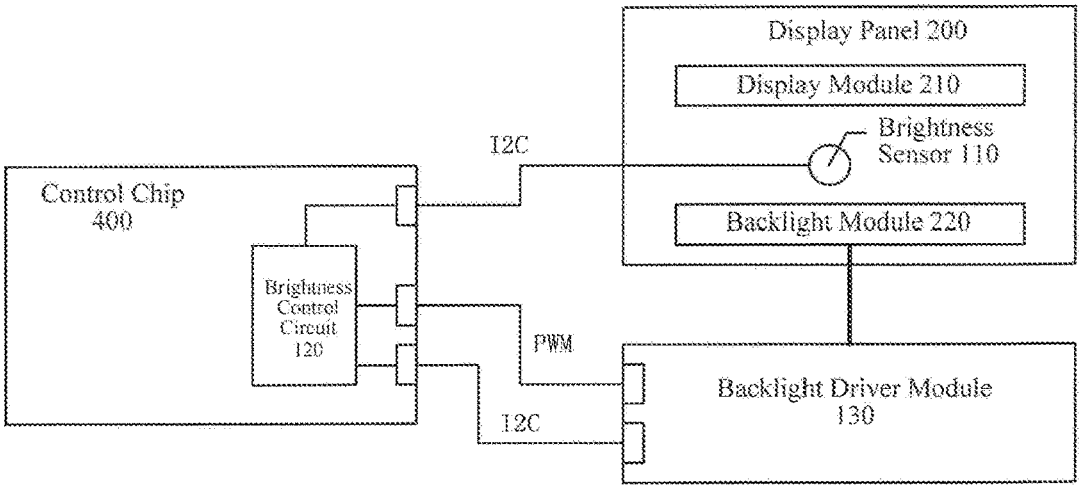
FIG. 11 is still another schematic diagram of the backlight brightness control device provided by one embodiment of the present disclosure.

For instance, FIG. 11 shows another backlight brightness control device provided by the embodiment. As shown in FIG. 10, in the backlight brightness control device provided by one example of the embodiment, the brightness control circuit may also transmit the duty cycle value to the backlight driver module, and the backlight driver module is configured to control the duty cycle of the current having the adjusted current value according to the duty cycle value. Thus, in addition to the stable control of the backlight brightness, the backlight brightness control device provided by the embodiment further provides a way for adjusting the backlight brightness by adjusting the duty cycle of the current having the adjusted current value. That is to say, the backlight brightness control device provided by the embodiment not only can achieve the stable control of the backlight brightness but also can adjust the backlight brightness. For instance, when a display device employing the backlight brightness control device provided by the embodiment is used for diagnostic treatment, the backlight brightness control device provided by the embodiment can achieve the stable control of the backlight brightness, so as to ensure the consistency and the integrity of medical images (e.g., DR, CR, CT and 3D images) displayed by the display device; and when the display device employing the backlight brightness control device provided by the embodiment is used for other general purposes, the user may adjust the brightness according to own preferences by the backlight brightness control device provided by the embodiment.

For instance, as shown in FIG. 11, the backlight driver module 130 is also communicated and connected with the brightness control circuit 120 through a PWM (pulse-width modulation) bus.

For instance, in the backlight brightness control device provided by one example of the embodiment, the duty cycle value is 100%, so as to ensure the consistency and the integrity of medical images (e.g., DR, CR, CT and 3D images) displayed by the display panel.

Figure 12:
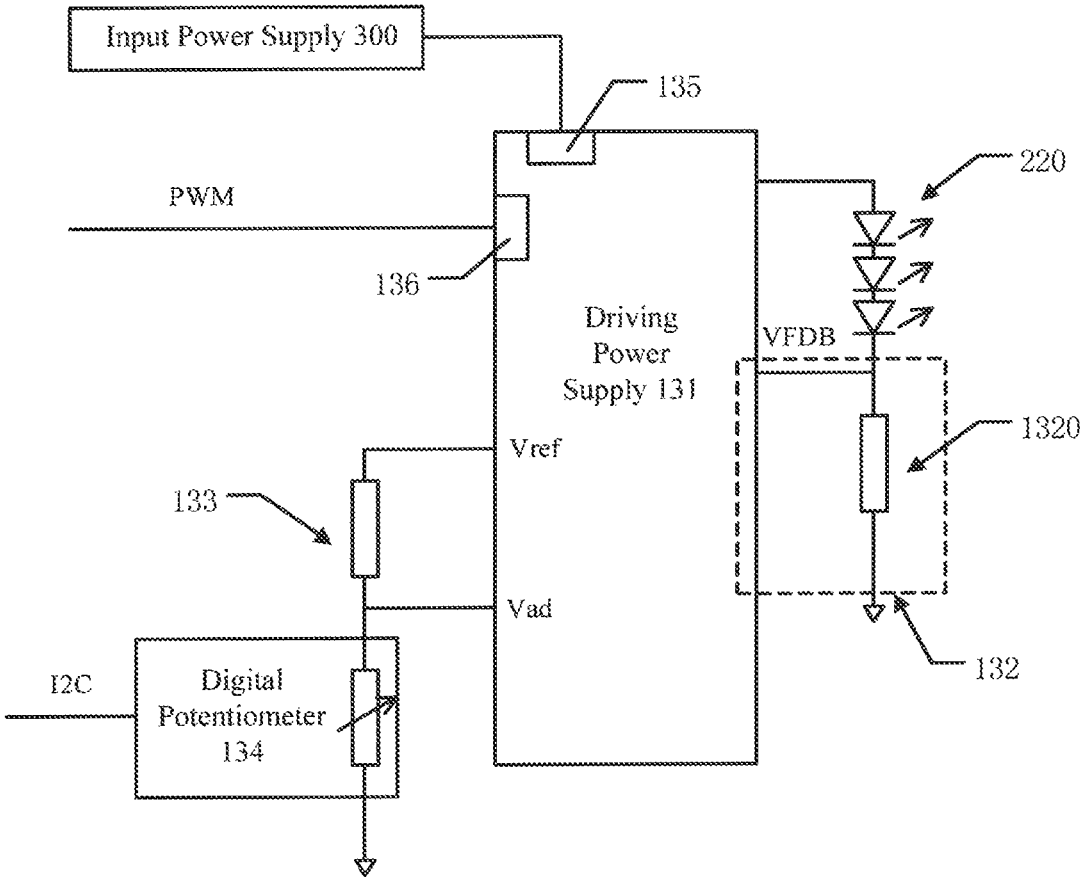
FIG. 12 is a schematic diagram of a backlight driver module provided by one embodiment of the present disclosure.

For instance, FIG. 12 is a schematic diagram of a backlight driver module provided by the embodiment of the present disclosure. As shown in FIG. 11, the backlight driver module 130 includes a driving power supply 131 and a current feedback circuit 132. The driving power supply 131 generates driving voltage and adjusts the current for driving a backlight module 220 to emit light by adjusting the driving voltage. The current feedback circuit 132 includes a feedback resistor 1320 connected in series with the backlight module 220, and may feedback the current for driving the backlight module 220 to emit light according to the feedback voltage VFDB on the feedback resistor 1320. Thus, the driving current on the backlight module 220 may be monitored according to the feedback voltage VFDB.

For instance, in the backlight driver module provided by one example of the embodiment, as shown in FIG. 12, the backlight driver module 130 further includes: a current-limiting resistor 133 and a digital potentiometer 134. The digital potentiometer 134 is communicated and connected with a brightness control circuit (not shown) and may convert the adjusted current value into resistance. An end of the current-limiting resistor 133 is connected with a standard reference voltage Vref, and another end of the current-limiting resistor 133 is connected to the digital potentiometer 134, so as to generate an adjustment voltage Vad on an end, connected with the current-limiting resistor 133, of the digital potentiometer 134 when the adjusted current value is inputted into the digital potentiometer 134. The driving power supply 131 may compare the feedback voltage VFDB and the adjustment voltage Vad and adjust the driving voltage according to a comparison result between the feedback voltage VFDB and the adjustment voltage Vad. For instance, in a case where the feedback voltage VFDB is greater than the adjustment voltage Vad, it indicates that the driving current of the backlight module 220 is greater than the adjusted current value, so the driving power supply 131 will reduce the driving voltage; and in a case where the feedback voltage VFDB is less than the adjustment voltage Vad, it indicates that the driving current of the backlight module 220 is less than the adjusted current value, so the driving power supply 131 will increase the driving voltage.

For instance, in the backlight driver module provided by one example of the embodiment, as shown in FIG. 12, the backlight driver module 130 further includes: a power interface 135 and a PWM interface 136 which are respectively connected with an input power supply 300 and a PWM bus. The input power supply supplies power for the driver module, and the PWM bus is configured to transmit the duty cycle value of the brightness control circuit to the backlight driver module. For instance, the input power supply may be 24V or 48V. At this point, the driving power may be a voltage booster circuit, namely raising 24V or 48V to the voltage required by the backlight module, e.g., 65V.

For instance, in the backlight driver module provided by one example of the embodiment, the backlight module may be an LED backlight module. Of course, the embodiment of the present disclosure includes but not limited thereto.

For instance, in the backlight driver module provided by one example of the embodiment, the display module may be a liquid crystal display (LCD) panel. Of course, the embodiment of the present disclosure includes but not limited thereto.

One embodiment of the present disclosure provides a display device, which includes: a display panel including a display module and a backlight module; and a backlight brightness control device which may be the backlight brightness control device provided by any example of the second embodiment. Thus, the display device can achieve the stable control of the backlight brightness, and hence may be used for medical diagnosis.

The following points need to be explained.

(1) In the drawings of the embodiments of the present disclosure, only the structures involved in the embodiments of the present disclosure are involved, and other structures may refer to the normal design.

(2) In the event of no conflict, the features of the same embodiment and different embodiments of the present disclosure may be combined with each other.

The foregoing descriptions are merely specific implementation manners of the present disclosure, but the scope of protection of the present disclosure is not limited thereto. Any person skilled in the art may easily think of change or replacement within the technical scope disclosed by the present disclosure. All of these should be covered by the scope of protection of this disclosure. Therefore, the protection scope of the present disclosure should be based on the protection scope of the claims.

What is claimed is:

1. A backlight brightness control device, comprising:

a brightness sensor configured to acquire a brightness sensing signal of a display panel;

a brightness control circuit communicated with the brightness sensor; and a backlight driver module communicated with the brightness control circuit and electrically connected with a backlight module of the display panel, wherein the brightness control circuit is configured to acquire a luminous brightness value of the display panel according to the brightness sensing signal, determine a relationship between the luminous brightness value and a preset brightness value, and transmit an adjusted current value to the backlight driver module according to the relationship; and the backlight driver module generates a current having the adjusted current value to drive the backlight module in the display panel to emit light, wherein the backlight driver module comprises:

a driving power supply configured to generate a driving voltage and adjust a current for driving the backlight module to emit light by adjusting the driving voltage; and a current feedback circuit comprising a feedback resistor connected in series with the backlight module, wherein the current feedback circuit is configured to feed back the current for driving the backlight module to emit light according to a feedback voltage on the feedback resistor, wherein the backlight driver module further comprises:

a current-limiting resistor; and a digital potentiometer communicated and connected with the brightness control circuit and configured to convert the adjusted current value into resistance, wherein an end of the current-limiting resistor is connected with a standard reference voltage, and another end of the current-limiting resistor is connected to the digital potentiometer, so as to generate an adjustment voltage at an end, connected with the current-limiting resistor, of the digital potentiometer, in a case where the adjusted current value is inputted into the digital potentiometer, and the driving power supply is configured to compare the feedback voltage with the adjustment voltage and adjust the driving voltage according to a comparison result.

2. The backlight brightness control device according to claim 1, wherein the brightness sensor is on a light-emitting side of the backlight module in the display panel or a light-emitting side of a display module in the display panel.

3. The backlight brightness control device according to claim 1, wherein the brightness control circuit is also configured to transmit a duty cycle value to the backlight driver module; and the backlight driver module is configured to control a duty cycle of the current having the adjusted current value according to the duty cycle value.

4. The backlight brightness control device according to claim 3, wherein the duty cycle value is 100%.

5. The backlight brightness control device according to claim 1, wherein the backlight driver module further comprises:

a power interface configured to be connected with an input power supply; and a pulse-width modulation (PWM) interface configured to be connected with a PWM bus, wherein the input power supply is configured to supply power for the backlight driver module, and the PWM bus is configured to transmit a duty cycle value transmitted by the brightness control circuit to the backlight driver module.

6. A display device, comprising:

a display panel comprising a display module and a backlight module; and a backlight brightness control device, wherein the backlight brightness control device comprises the backlight brightness control device according to claim 1.

* * * * *